US010964507B2

(12) United States Patent
Hoffman et al.

(10) Patent No.: US 10,964,507 B2
(45) Date of Patent: Mar. 30, 2021

(54) X-RAY SOURCE VOLTAGE SHIELD

(71) Applicant: Moxtek, Inc., Orem, UT (US)

(72) Inventors: David S. Hoffman, Draper, UT (US); Vincent F. Jones, Cedar Hills, UT (US); Eric Miller, Provo, UT (US)

(73) Assignee: Moxtek, Inc., Orem, UT (US)

( * ) Notice: Subject to any disclaimer, the term of this patent is extended or adjusted under 35 U.S.C. 154(b) by 190 days.

(21) Appl. No.: 16/387,455

(22) Filed: Apr. 17, 2019

(65) Prior Publication Data

US 2019/0348249 A1 Nov. 14, 2019

Related U.S. Application Data

(60) Provisional application No. 62/669,757, filed on May 10, 2018.

(51) Int. Cl.
*H01J 35/16* (2006.01)
*H05G 1/06* (2006.01)

(52) U.S. Cl.
CPC ..... *H01J 35/16* (2013.01); *H05G 1/06* (2013.01); *H01J 2235/166* (2013.01)

(58) Field of Classification Search
CPC ..... H01J 35/16; H01J 2235/166; H01J 2235/165; H05G 1/06
See application file for complete search history.

(56) References Cited

U.S. PATENT DOCUMENTS

| | | | | |
|---|---|---|---|---|
| 6,288,840 | B1 | 9/2001 | Perkins | |
| 6,665,119 | B1 | 12/2003 | Kurtz et al. | |
| 8,792,619 | B2 | 7/2014 | Miller | |
| 8,903,047 | B1 | 12/2014 | Wang et al. | |
| 9,087,670 | B2 | 7/2015 | Wang | |
| 9,726,897 | B2 | 8/2017 | Huang et al. | |
| 10,139,536 | B2 | 11/2018 | Wang et al. | |
| 10,139,537 | B2 | 11/2018 | Nielson et al. | |
| 10,234,613 | B2 | 3/2019 | Wangensteen et al. | |
| 2007/0297052 | A1 | 12/2007 | Wang et al. | |
| 2008/0048135 | A1* | 2/2008 | Cernasov | G21K 1/10 250/515.1 |
| 2012/0075699 | A1 | 3/2012 | Davis et al. | |
| 2014/0300964 | A1 | 10/2014 | Davis et al. | |

(Continued)

FOREIGN PATENT DOCUMENTS

| | | | |
|---|---|---|---|
| JP | 2014-086147 | A | 5/2014 |
| JP | 2015-230754 | A | 12/2015 |

(Continued)

OTHER PUBLICATIONS

Komm et al. ("Gaseous Dielectric High Voltage Insulation for Space Applications" D. Komm and D. Hoppe, 2008 IEEE International Vacuum Electronics Conference, pp. 378-379 (Year: 2008).*

*Primary Examiner* — David P Porta
*Assistant Examiner* — Meenakshi S Sahu
(74) *Attorney, Agent, or Firm* — Thorpe, North & Western, LLP

(57) ABSTRACT

A shield around an x-ray tube, a voltage multiplier, or both can improve the manufacturing process by allowing testing earlier in the process and by providing a holder for liquid potting material. The shield can also improve voltage stand-off. A shielded x-ray tube can be electrically coupled to a shielded power supply.

20 Claims, 8 Drawing Sheets

(56) References Cited

U.S. PATENT DOCUMENTS

| | | | | |
|---|---|---|---|---|
| 2016/0073485 | A1 | 3/2016 | Kwan | |
| 2017/0068103 | A1 | 3/2017 | Huang et al. | |
| 2017/0293059 | A1 | 10/2017 | Nielson et al. | |
| 2018/0052257 | A1 | 2/2018 | Nielson et al. | |
| 2019/0041564 | A1 | 2/2019 | Nielson et al. | |
| 2019/0182943 | A1* | 6/2019 | Steck | H05G 1/10 |

FOREIGN PATENT DOCUMENTS

| | | | | |
|---|---|---|---|---|
| JP | 2015-232944 | A | 12/2015 | |
| WO | WO2013095760 | * | 7/2013 | H05G 1/10 |

* cited by examiner

X-RAY SOURCE VOLTAGE SHIELD

CLAIM OF PRIORITY

This application claims priority to U.S. Provisional Patent Application No. 62/669,757, filed on May 10, 2018, which is incorporated herein by reference.

FIELD OF THE INVENTION

The present application is related generally to x-ray sources.

BACKGROUND

Small size and light weight are important characteristics of x-ray sources in order to allow portability and insertion into small spaces. High power, as indicated by bias voltage differential, can also be important. As power requirements increase, x-ray source size and weight must normally be increased due to increased electrical insulation needed for voltage isolation. It would be beneficial to provide high power x-ray sources with reduced size and weight.

Much of the cost of x-ray sources is the result of difficult manufacturing processes. It would be beneficial to improve the manufacturing process in order to reduce the cost of the x-ray source.

Users of x-ray sources can be injured by stray x-rays. X-ray sources can fail due to arcing of high voltage. Electromagnetic waves from some x-ray source components can interfere with other components. Blocking x-rays, reducing arcing failure, and reducing unwanted electromagnetic interference can also be useful x-ray source characteristics.

SUMMARY

It has been recognized that it would be advantageous to provide small, light x-ray sources which are relatively easy to manufacture. It has been recognized that it would be advantageous to block stray x-rays, reduce x-ray source arcing failure, and reduce unwanted electromagnetic interference. The present invention is directed to various embodiments of x-ray sources, x-ray source components, and methods of manufacturing x-ray sources and components that satisfy these needs. Each embodiment may satisfy one, some, or all of these needs.

An x-ray tube shield can wrap at least partially around, and can be spaced apart from, an x-ray tube. X-ray tube insulation, comprising a solid, electrically-insulative material, can separate the x-ray tube shield from the x-ray tube. A material composition of the x-ray tube insulation can be different than a material composition of the x-ray tube shield.

A power supply shield can wrap at least partially around, and can be spaced apart from, a voltage multiplier. Power supply insulation, comprising a solid, electrically-insulative material, can separate the power supply shield from the voltage multiplier. A material composition of the power supply insulation can be different than a material composition of the power supply shield.

BRIEF DESCRIPTION OF THE DRAWINGS (DRAWINGS MIGHT NOT BE DRAWN TO SCALE)

FIG. 1 is a schematic, cross-sectional side-view of a high voltage component 10 including a shield 11 spaced apart from a high voltage device 13, in accordance with an embodiment of the present invention.

FIG. 2*a* is a schematic, cross-sectional side-view of a high voltage component 20*a*, similar to high voltage component 10, but with insulating fluid 21 between the shield 11 and the high voltage device 13, in accordance with an embodiment of the present invention.

FIG. 2*b* is a schematic, cross-sectional side-view of a high voltage component 20*b*, similar to high voltage component 10, but with high voltage insulation 22 between the shield 11 and the high voltage device 13, in accordance with an embodiment of the present invention.

FIG. 3 is a schematic perspective-view of high voltage component 30, with a cylinder-shaped shield 11, in accordance with an embodiment of the present invention.

FIG. 4 is a schematic perspective-view of high voltage component 40, with the shield 11 wrapping partially around the high voltage device 13, in accordance with an embodiment of the present invention.

Figure 7:
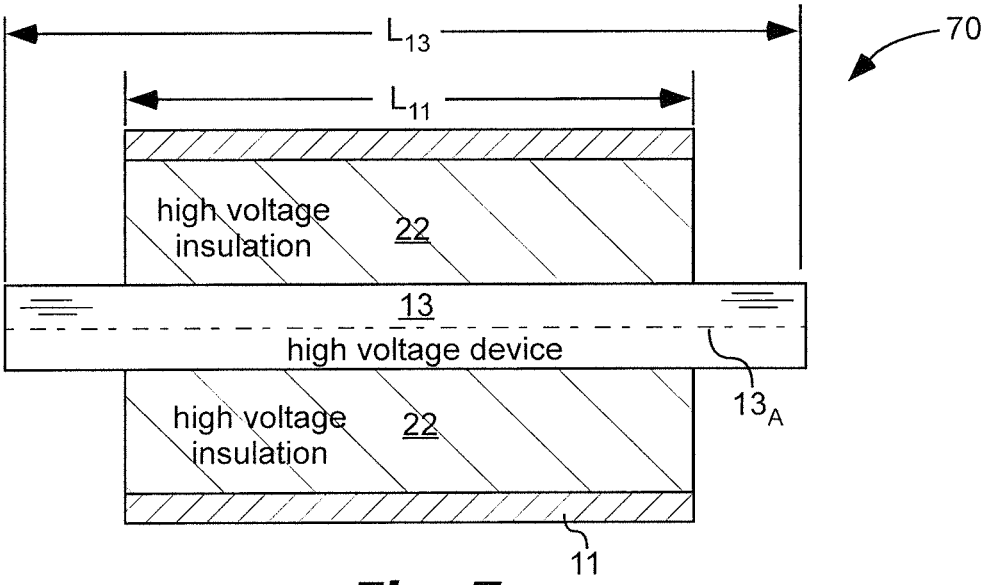
Figure 8:
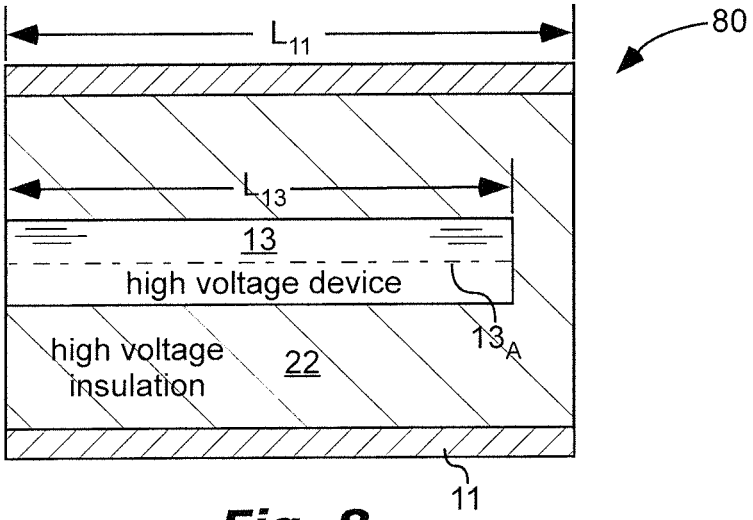

FIGS. 7-8 are schematic, cross-sectional side-views of high voltage components 70 and 80, showing a relationship between a length $L_{13}$ of the high voltage device 13 and a length $L_{11}$ of the shield 11, in accordance with embodiments of the present invention.

Figure 9:
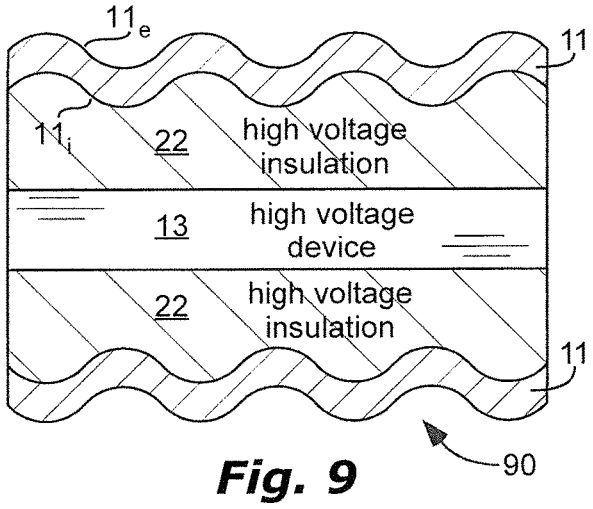
Figure 10:
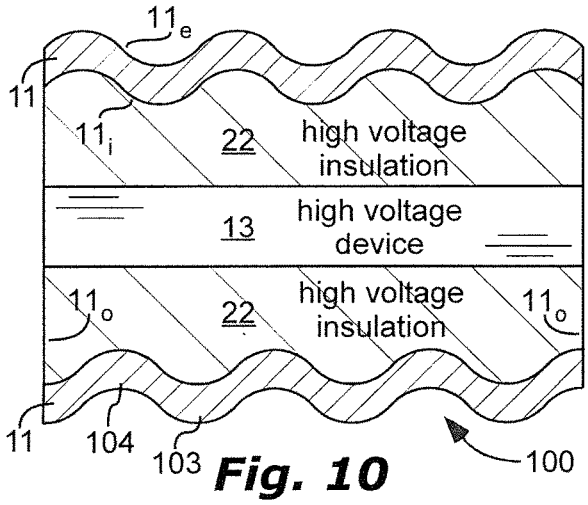

FIGS. 9-10 are schematic, cross-sectional side-views of high voltage components 90 and 100 including a shield 11 with corrugated surfaces, in accordance with embodiments of the present invention.

Figure 11:
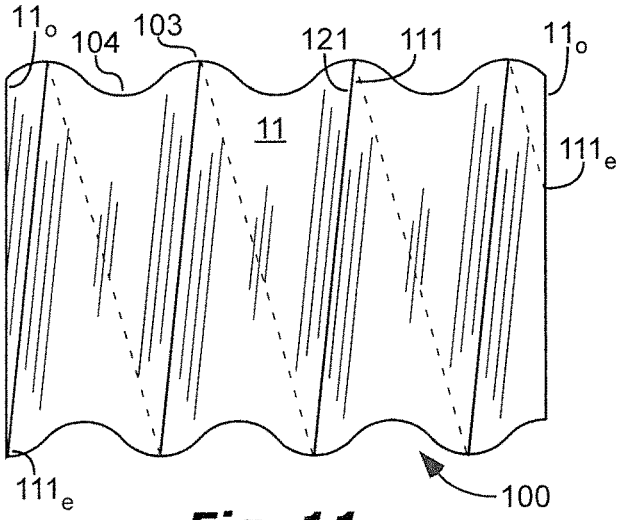

FIG. 11 is a schematic side-view of high voltage component 100 including a continuous line of material 111 on a continuous spiral of the shield 11, in accordance with an embodiment of the present invention.

Figure 12:
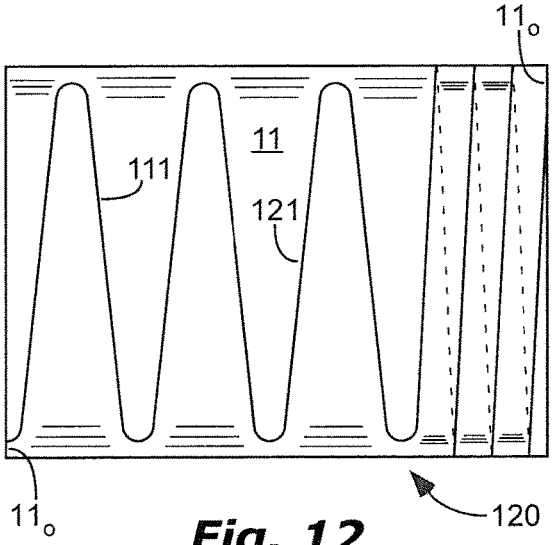

FIG. 12 is a schematic side-view of high voltage component 120 including a continuous line of material 111 wrapping multiple times around the shield 11 and arranged in a serpentine pattern on the shield 11, in accordance with an embodiment of the present invention.

Figure 13:
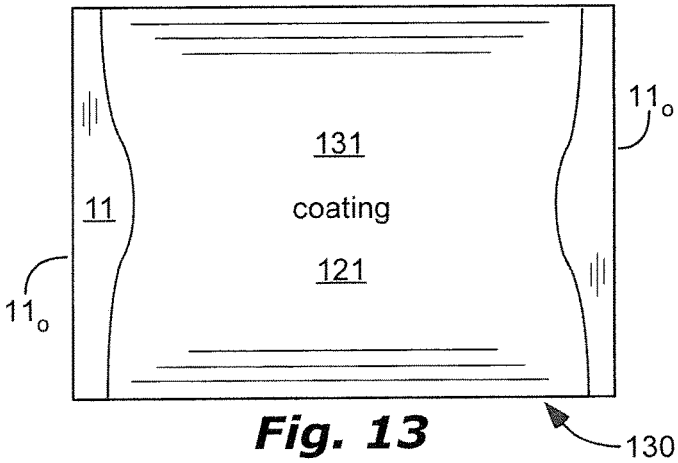

FIG. 13 is a schematic side-view of high voltage component 130 including a continuous layer of coating 131 on the shield 11, in accordance with an embodiment of the present invention.

Figure 14:
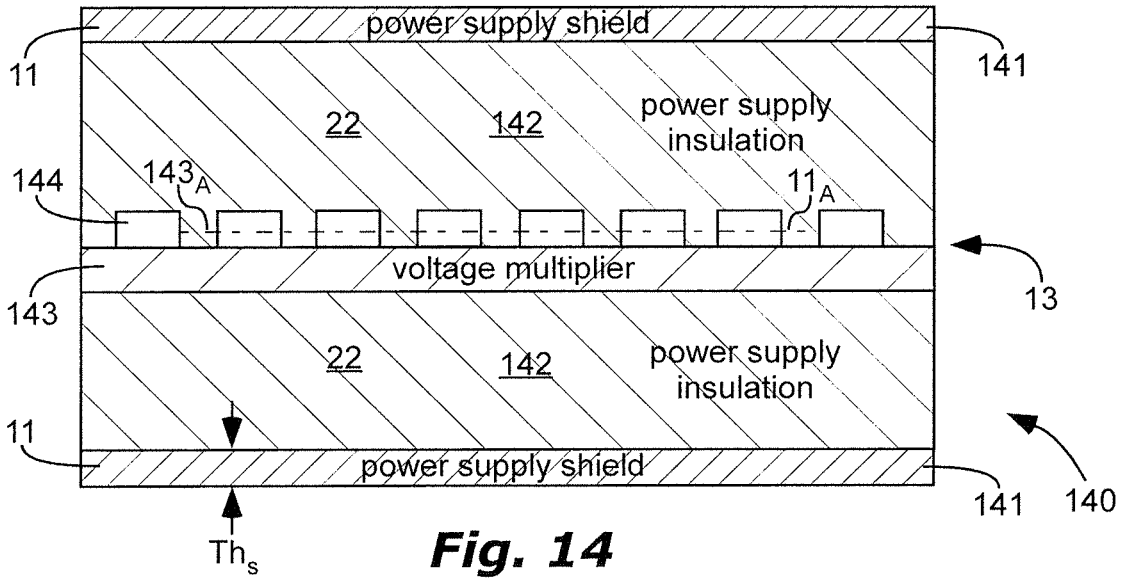

FIG. 14 is a schematic, cross-sectional side-view of a shielded power supply 140 including a power supply shield 141 spaced apart from a voltage multiplier 143 by power supply insulation 142, in accordance with an embodiment of the present invention.

Figure 15:
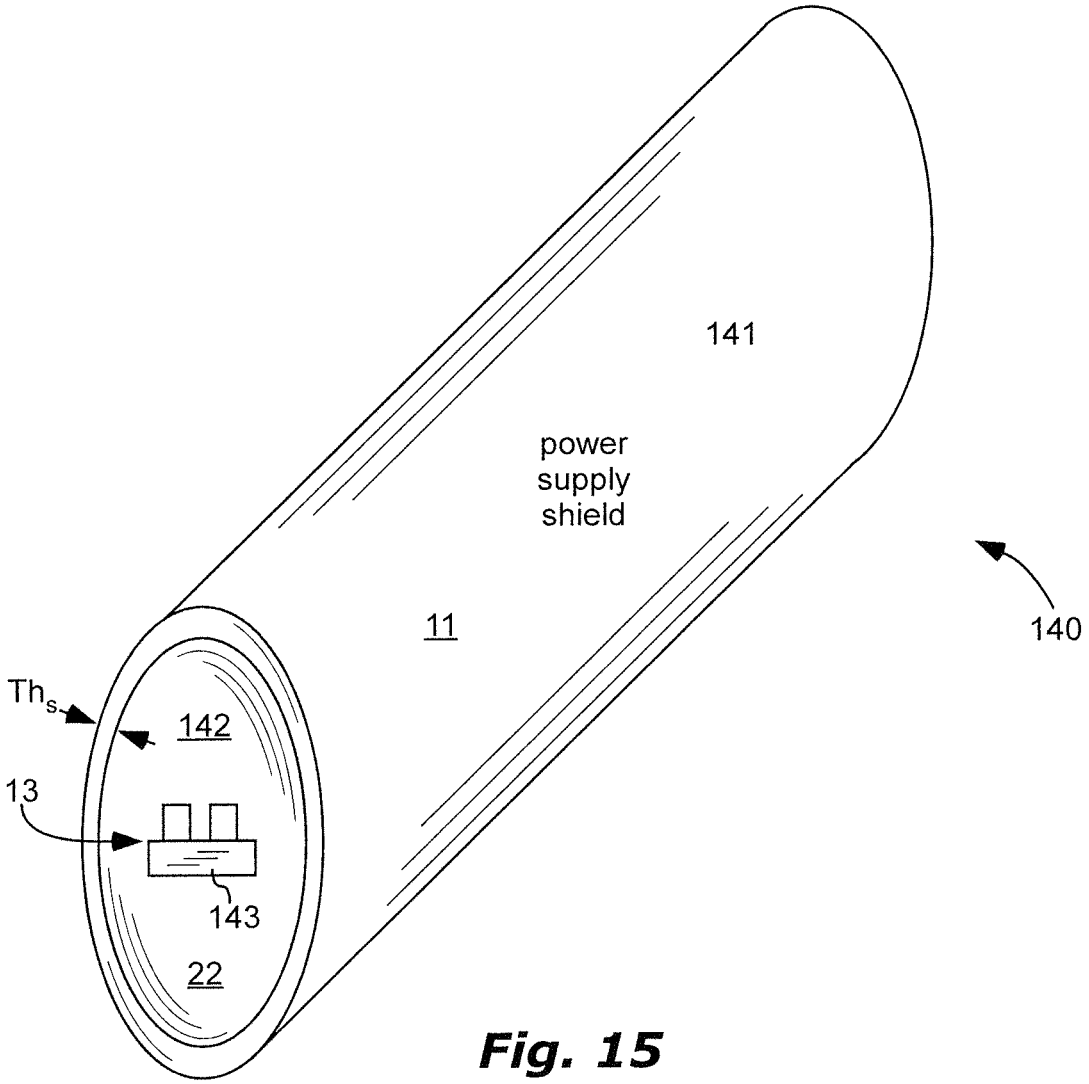

FIG. 15 is a schematic perspective-view of shielded power supply 140, in accordance with an embodiment of the present invention.

Figure 16:
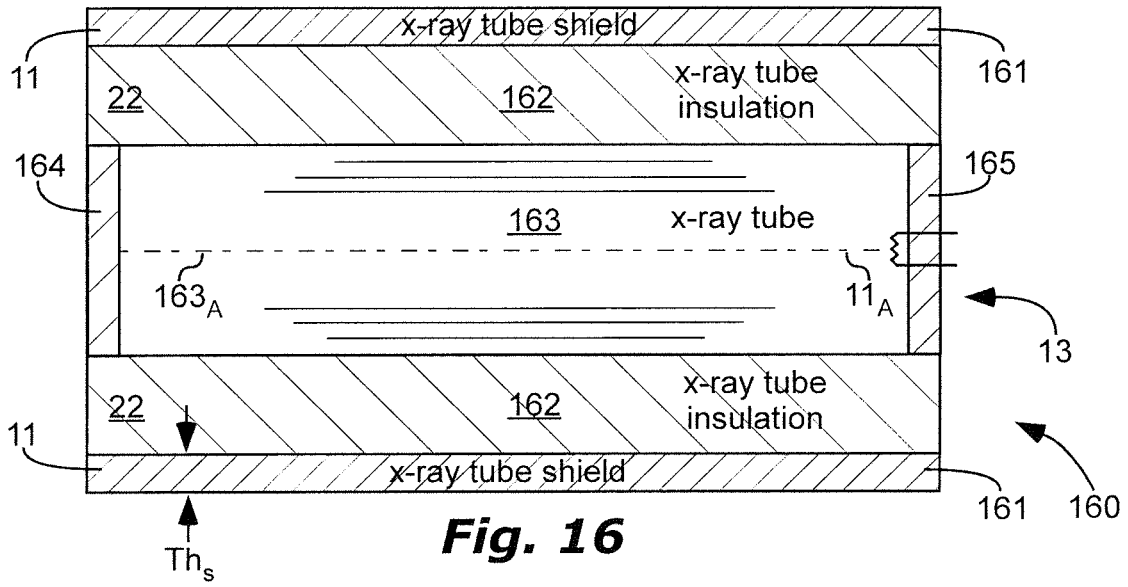

FIG. 16 is a schematic, cross-sectional side-view of a shielded x-ray tube 160 including an x-ray tube shield 161 spaced apart from an x-ray tube 163 by x-ray tube insulation 162, in accordance with an embodiment of the present invention.

Figure 17:
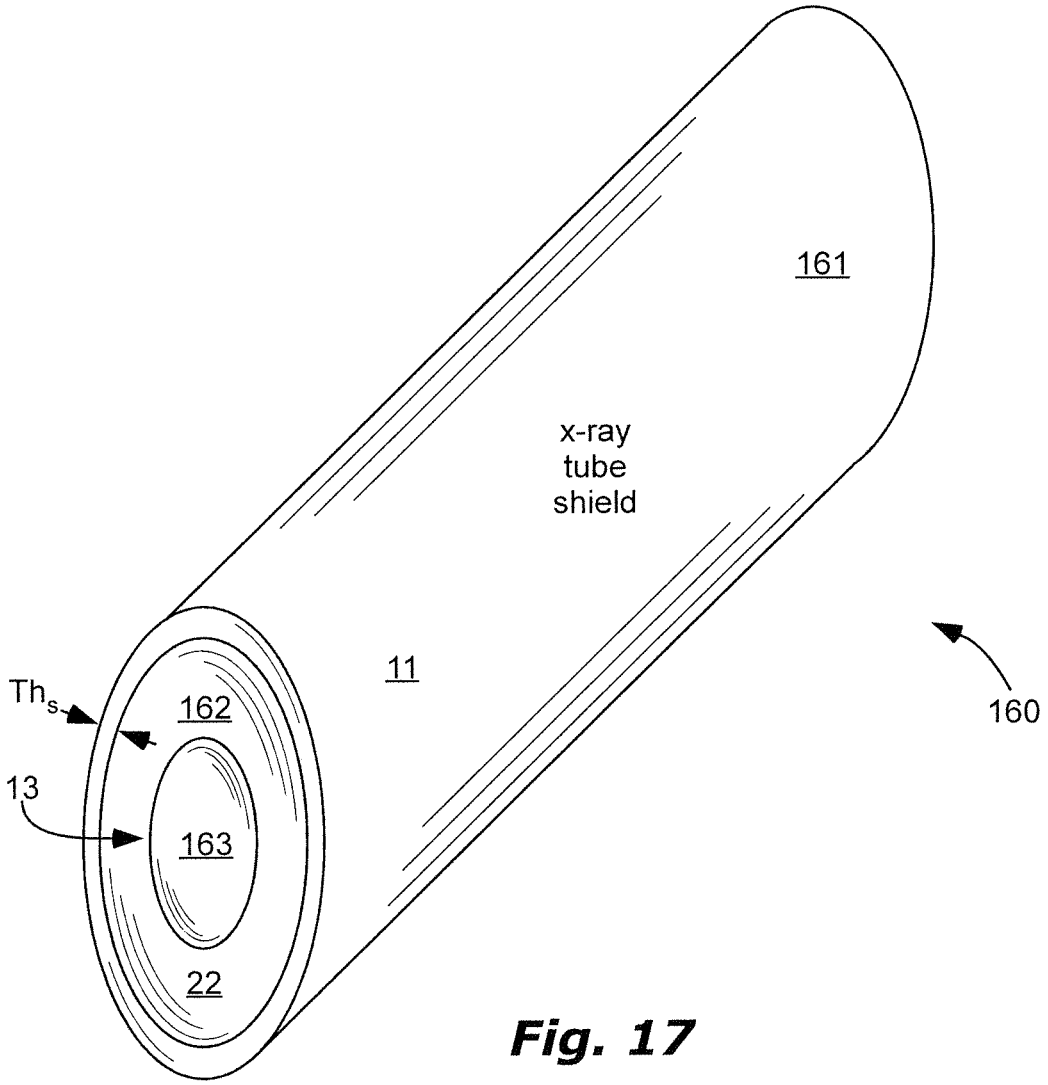

FIG. 17 is a schematic perspective-view of shielded x-ray tube 160, in accordance with an embodiment of the present invention.

Figure 18:
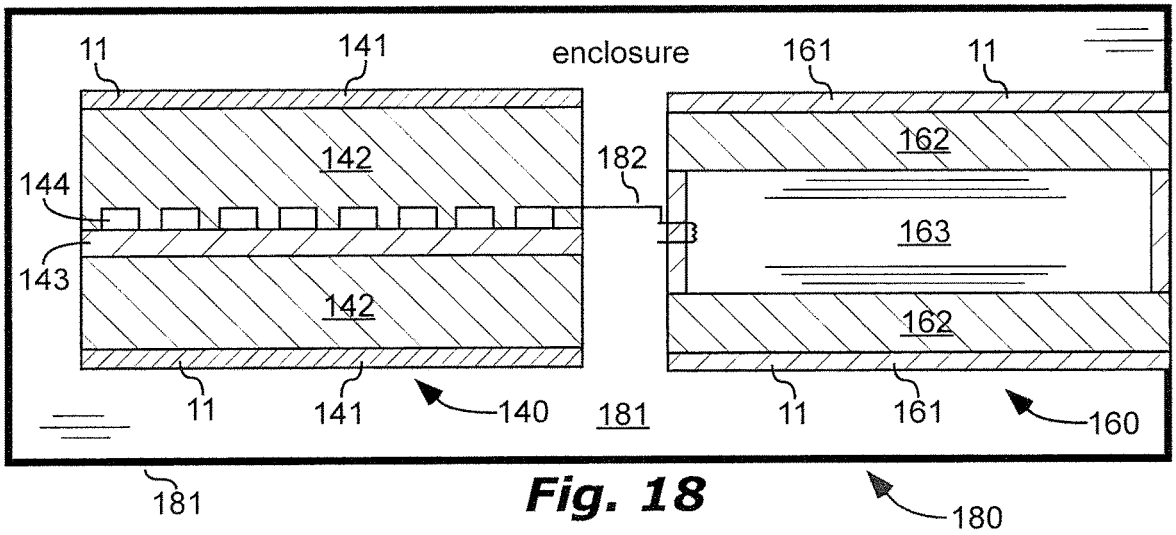

FIG. 18 is a schematic, cross-sectional side-view of an x-ray source 180 including a shielded power supply 140 electrically coupled to a shielded x-ray tube 160 inside of an enclosure 181, in accordance with an embodiment of the present invention.

Figure 19:
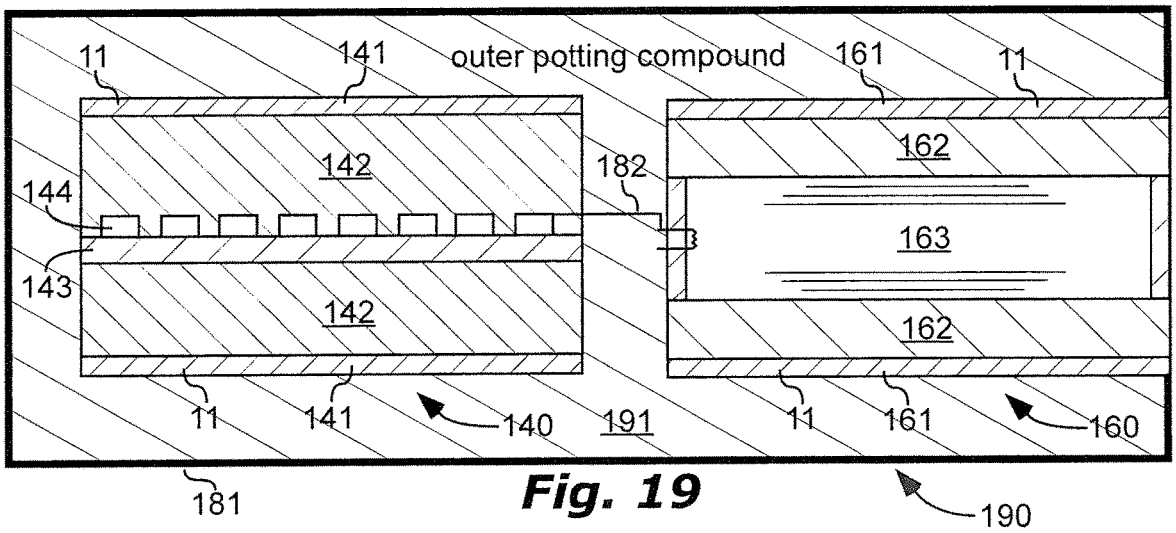

FIG. 19 is a schematic, cross-sectional side-view of an x-ray source 190, similar to x-ray source 180, but with outer potting compound 191 between the enclosure 181 and the shielded power supply 140 and between the enclosure 181 and the shielded x-ray tube 160, in accordance with an embodiment of the present invention.

Figure 20:
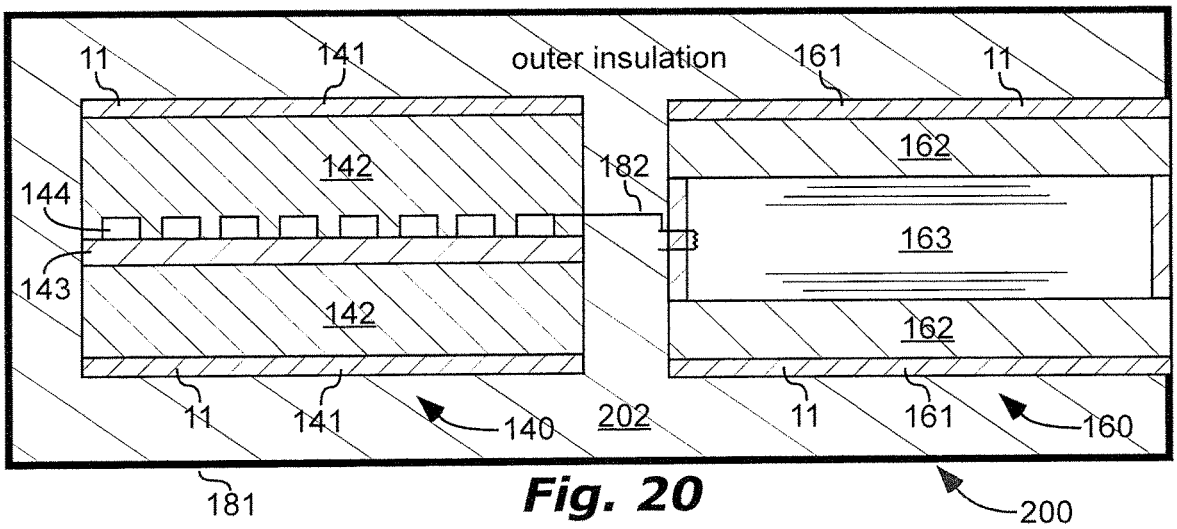

FIG. 20 is a schematic, cross-sectional side-view of an x-ray source 200, similar to x-ray source 180, but with outer insulation 202 between the enclosure 181 and the shielded power supply 140 and between the enclosure 181 and the shielded x-ray tube 160, in accordance with an embodiment of the present invention.

DEFINITIONS

As used herein, the term "adjoin" means direct and immediate contact.

As used herein, the term "GPa" means gigaPascal.

As used herein, the term "kV" means kilovolt(s).

As used herein, the term "mm" means millimeter(s).

As used herein, the term "parallel" means exactly parallel, or within 30° of exactly parallel. The term "parallel" can mean within 0.1°, within 1°, within 5°, within 10°, within 15°, or within 20° of exactly parallel if explicitly so stated in the claims.

As used herein, the term "x-ray tube" means a device for producing x-rays, and which is traditionally referred to as a "tube", but need not be tubular in shape.

DETAILED DESCRIPTION

As illustrated in FIGS. 1-10, high voltage components 10, 20*a*, 20*b*, 30, 40, 50, 60, 70, 80, 90, and 100 can include a shield 11 spaced apart from a high voltage device 13 by a gap, which can be an annular gap. The high voltage device 13 can be operable at a high voltage such as for example ≥1 kV, ≥5 kV, ≥10 kV, ≥20 kV, or ≥40 kV.

The shield 11 can be electrically insulative to improve high voltage standoff, reduce amount and weight of electrical insulation, or both. For example, an electrical resistivity of the shield 11 can be $\geq 10^6$ ohm*m, $\geq 10^8$ ohm*m, $\geq 10^{10}$ ohm*m, or $\geq 10^{12}$ ohm*m. Sometimes, an electrically conductive shield is desirable to help mitigate unwanted electromagnetic interference. For example, an electrical resistivity of the shield 11 can be $\leq 10^{-4}$ ohm*m, ≤0.01 ohm*m, ≤0.1 ohm*m, or ≤1 ohm*m. It can be helpful, for blocking electromagnetic interference, for the shield to have some electrical resistance. Therefore, the shield 11 can have electrical resistivity of $\geq 10^{-8}$ ohm*m, $\geq 10^{-7}$ ohm*m, $10^{-6}$ ohm*m, or $\geq 10^{-5}$ ohm*m. All resistivity values herein are at 20° C.

The shield can include high atomic number (Z) materials for blocking stray x-rays. For example, the shield can include material(s) with Z≥24, Z≥40, or Z≥73.

Some high voltage components, including x-ray sources, may need high temperature processing during manufacture. Thus, high temperature resistance can be important. For example, the shield 11 can have a melting point of ≥250° C., ≥400° C., ≥500° C., or ≥600° C.

Example materials of the shield 11, which can meet the above criteria, include ceramic, plastic, glass, polymer, polyimide or combinations thereof. These materials can be impregnated with other materials such as metals or metalloids to provide the desired properties as described above.

Figure 2A:
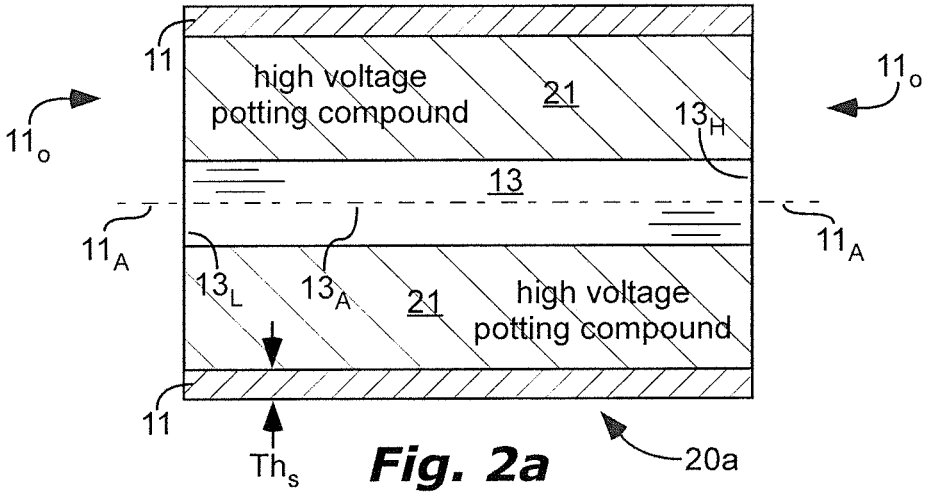

As illustrated in FIG. 2*a*, the shield 11 can be spaced apart from the high voltage device 13 by high voltage potting compound 21. The high voltage potting compound 21 can be a liquid. The shield 11 can be a holder for containing the high voltage potting compound 21 while it cures, thus providing an easier manufacturing process. As illustrated in FIGS. 2*b*-10, the shield 11 can be spaced apart from the high voltage device 13 by high voltage insulation 22, which can be a solid. The high voltage insulation 22 can be cured high voltage potting compound 21. Alternatively, the high voltage insulation 22 can be a gaseous standoff material or an insulative oil. The high voltage insulation 22 can partially or completely fill the gap between the shield 11 and the high voltage device 13.

Figure 2B:
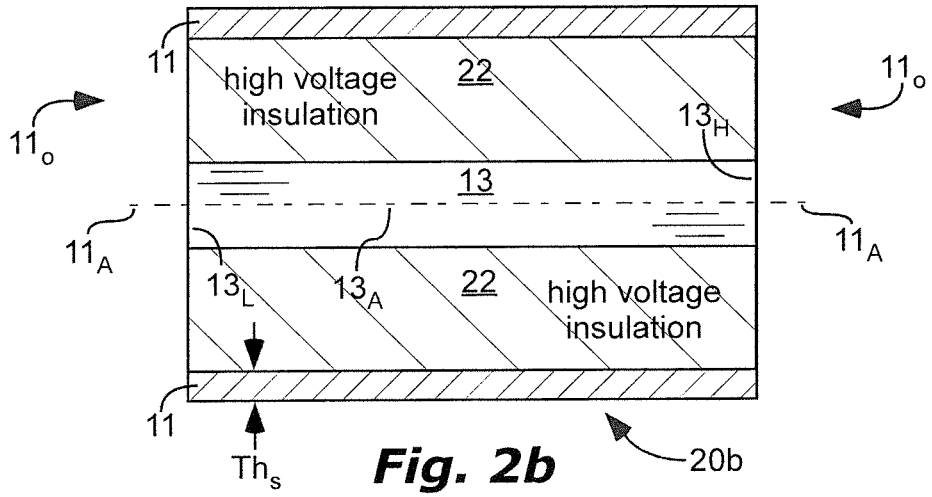

As illustrated in FIGS. 2*a*-2*b*, the high voltage device 13 can have a longitudinal axis $\mathbf{13}_A$ extending from a location on the high voltage device 13 with a lowest absolute value of voltage $\mathbf{13}_L$ to a location on the high voltage device 13 with a highest absolute value of voltage $\mathbf{13}_H$. The shield 11 can have two open ends $\mathbf{11}_o$ located opposite of each other and a longitudinal axis $\mathbf{11}_A$ extending through a center of one open end $\mathbf{11}_0$ and through a center of the other open end $\mathbf{11}_o$. The longitudinal axis $\mathbf{13}_A$ of the high voltage device 13 can be aligned or coaxial with and/or can be parallel to the longitudinal axis $\mathbf{11}_A$ of the shield 11. Such alignment can provide improved shaping of electrical field gradients.

Figure 3:
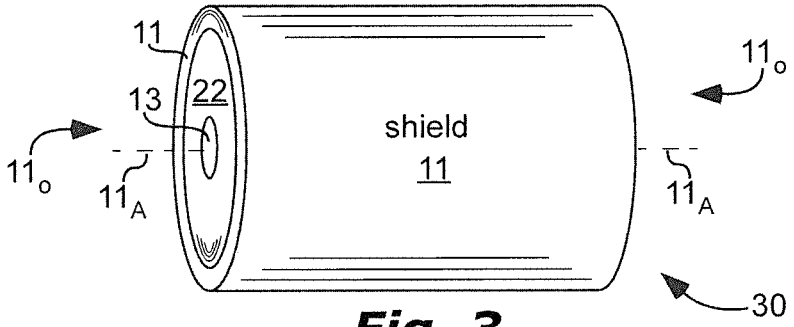
Figure 4:
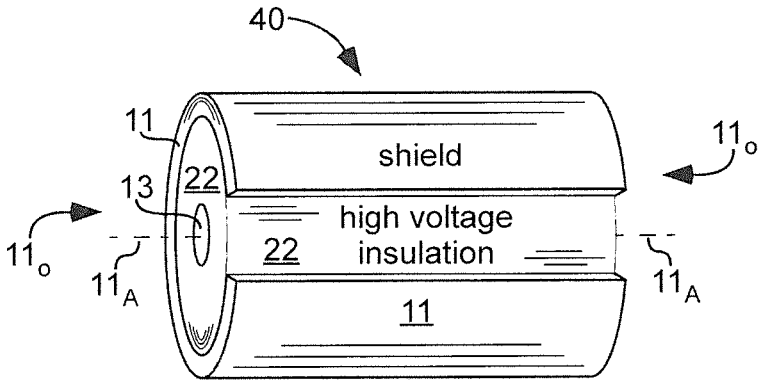

As shown in FIG. 3, the shield 11 can encircle or wrap completely around the high voltage device 13 or can encircle or wrap completely around the longitudinal axis $\mathbf{11}_A$ of the shield 11. Also illustrated in FIG. 3, the shield 11 can have a cylindrical shape and can have two open ends $\mathbf{11}_o$ located opposite of each other. The shield 11 can have other shapes. For example, as illustrated in FIG. 4, the shield 11 can wrap partially around the high voltage device 13 along the longitudinal axis $\mathbf{13}_A$ or partially around the longitudinal axis $\mathbf{11}_A$ of the shield 11. For example, the shield 11 can wrap ≥50%, ≥75%, ≥90%, ≥95%, or ≥98% of a circumference around the high voltage device 13. An opening or channel in the shield 11 can extend from one open end $\mathbf{11}_o$ to the other open end $\mathbf{11}_o$. A choice between different shapes of the shield 11 can be based on availability, ease of encasing the high voltage device 13 in the shield 11, voltage standoff, and desired shaping of electrical field lines.

Figure 5:
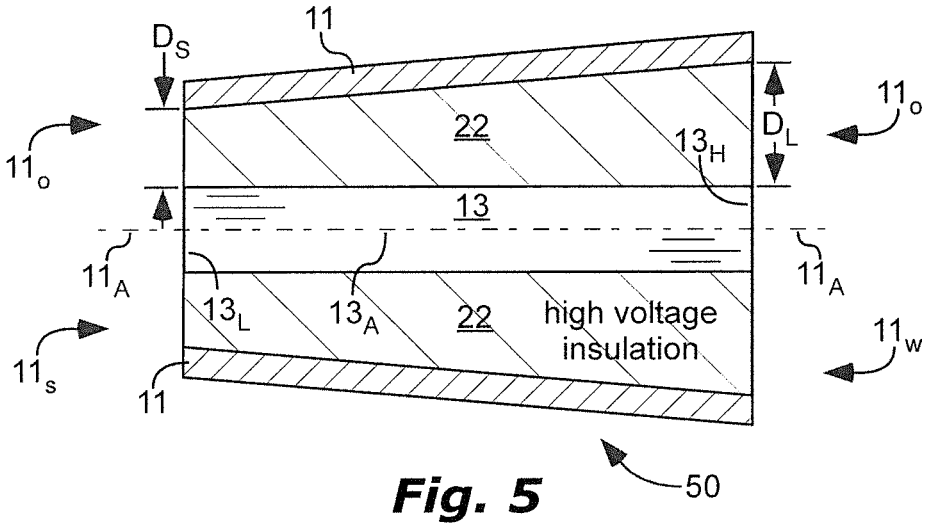
FIG. 5 is a schematic, cross-sectional side-view of a high voltage component 50 including a shield 11 with a conical frustum shape, in accordance with an embodiment of the present invention.
Figure 6:
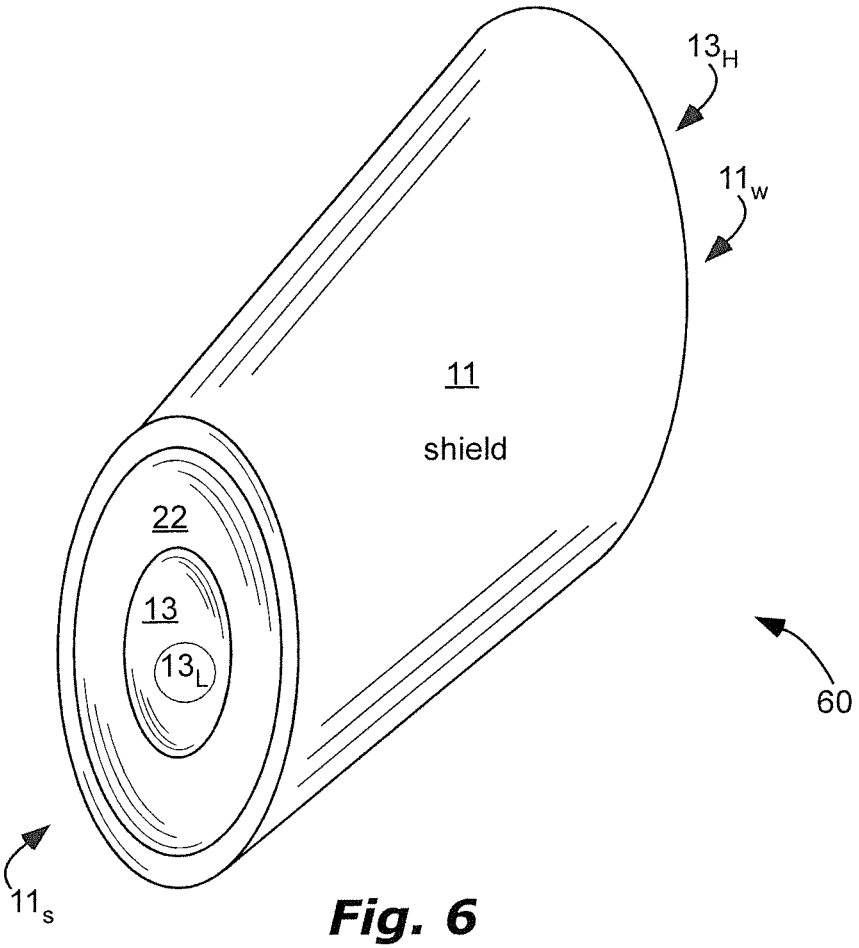
FIG. 6 is a schematic perspective-view of high voltage component 60 including a shield 11 with a conical frustum shape, in accordance with an embodiment of the present invention.

Another possible shape of the shield 11, illustrated in FIGS. 5-6, is a conical frustum shape. A conical frustum shape can be used for shaping the electrical field and improving voltage standoff. The conical frustum shape can have two open ends $\mathbf{11}_o$ located opposite of each other, including a larger or wider end $\mathbf{11}_w$ and a smaller end $\mathbf{11}_s$. For example, the wider end $\mathbf{11}_w$ can be ≥1.1, ≥1.2, ≥1.6, or ≥2 times larger than the smaller end $\mathbf{11}_s$. As another example, the wider end $\mathbf{11}_w$ can be ≤3 or ≤10 times larger than the smaller end $\mathbf{11}_s$. Example distances between an inner surface of the shield 11 and the high voltage device 13 include a shortest distance $D_s$ of between 1.5 mm and 15 mm and a longest distance $D_L$ of between 3 mm and 50 mm. For voltage standoff, the wider end $\mathbf{11}_w$ can be closer to a location on the high voltage device 13 with a highest absolute value of voltage and the smaller end can be closer to a location on the high voltage device 13 with a lowest absolute value of voltage.

As illustrated in FIGS. 7-8, the shield 11 can partially wrap or fully encircle the high voltage device 13 along some or all of the longitudinal axis $\mathbf{13}_A$, such as for example ≥30%, ≥50%, ≥80%, ≥90%, ≥95%, or 100% of a length $L_{13}$ of the high voltage device 13. The high voltage device 13 can be longer than the shield 11, as shown in FIG.

7 ($L_{13}>L_{11}$), about the same length, as shown in FIGS. 1-2*b* and 5-6, or shorter than the shield 11 as shown in FIG. 8 ($L_{13}<L_{11}$).

The shield 11 can have sufficient thickness $Th_s$ (FIGS. 1-2*b*) to provide structural support. For example, the thickness $Th_s$ of the shield can include: $Th_s \geq 0.1$ mm, ≥0.5 mm, ≥1 mm, or ≥3 mm. This thickness $Th_s$ can be a minimum thickness of the entire shield 11 if explicitly so stated in the claims.

The shield 11 can be thin to avoid unnecessary added weight. For example, the thickness $Th_s$ of the shield can include: ≤5 mm, ≤10 mm, or ≤25 mm. This thickness $Th_s$ can be a maximum thickness of the entire shield 11 if explicitly so stated in the claims.

As illustrated in FIGS. 9-11, an internal surface $\mathbf{11}_i$ of the shield 11, an external surface $\mathbf{11}_e$ of the shield 11, or both, can be corrugated. The corrugated surface(s) can improve high voltage standoff by increasing the distance for an electric arc to travel.

As illustrated on high voltage component 100 in FIGS. 10-11, the corrugated external surface can include a ridge 103 and a furrow 104 extending in a continuous spiral. The continuous spiral can extend between one open end $\mathbf{11}_o$ of the shield 11 and the opposite open end $\mathbf{11}_o$. This continuous spiral can allow easier application of a coating 121 on the ridge 103. The coating 121 can extend continuously in a line of material 111 on the continuous spiral. The line of material 111 can have electrical resistance optimized for shaping of electrical field lines, optimized to be a voltage sensing resistor, or both. The voltage sensing resistor can be electrically-coupled across and configured for measurement of voltage across the high voltage device 13. For example, electrical resistance from one end $\mathbf{111}_e$ to an opposite end $\mathbf{111}_e$ of the line of material 111 can be ≥1 megaohm, ≥10 megaohms, or ≥100 megaohms and ≤10,000 megaohms, ≤100,000 megaohms, or ≤1,000,000 megaohms.

As illustrated on high voltage component 120 in FIG. 12, the continuous line of material 111 can wrap multiple times around the shield 11, can be arranged in a serpentine pattern, or both. Examples of a relationship between a length $L_{111}$ of the continuous line of material 111 compared to a shortest distance $L_{11}$ between the two open ends $\mathbf{11}_o$ of the shield 11 include: $L_{111}/L_{11} \geq 3$, $L_{111}/L_{11}$ 10, $L_{111}/L_{11} \geq 20$, $L_{111}/L_{11} \geq 50$, and $L_{111}/L_{11} \geq 100$.

Alternatively, as illustrated on high voltage component 130 in FIG. 13, instead of a line of material 111, the coating 121 on the surface of the shield 11 can be sheet of material or a continuous layer of coating 131. The continuous layer of coating 131 can coat all or most (e.g. ≥50%, ≥75%, ≥90%, or ≥95%) of the internal surface $\mathbf{11}_i$ (FIGS. 9-10) of the shield 11, the external surface 11, (FIGS. 9-10) of the shield 11, or both. The continuous layer of coating 131 can have electrical resistance optimized for shaping of electrical field lines. For example, electrical resistance between the continuous layer of coating 131 nearest one open end $\mathbf{11}_o$ of the shield 11 and the continuous layer of coating 131 nearest the opposite open end $\mathbf{11}_o$ of the shield 11 can be ≥1 megaohm, ≥10 megaohms, or ≥100 megaohms and ≤10,000 megaohms, ≤100,000 megaohms, or ≤1,000,000 megaohms. The continuous layer of coating 131 can be a voltage sensing resistor electrically-coupled across and configured for measurement of voltage across the high voltage device 13.

As illustrated on in FIGS. 14-15, the high voltage component as described above can be a shielded power supply 140. The high voltage device 13 described above can be a voltage multiplier 143 with electronic components 144, the high voltage insulation 22 described above can be power supply insulation 142, and the shield 11 described above can be a power supply shield 141. The voltage multiplier 143 can be configured to generate a high voltage, such as for example ≥1 kV, ≥5 kV, ≥10 kV, ≥20 kV, or ≥40 kV. The voltage multiplier 143 can be a Cockroft-Walton voltage multiplier. A longitudinal axis $\mathbf{143}_A$ of the voltage multiplier 143 can extend from a location on the voltage multiplier with a lowest absolute value of voltage to a location on the voltage multiplier with a highest absolute value of voltage. The longitudinal axis $\mathbf{143}_A$ of the voltage multiplier 143 can be parallel to or aligned or coaxial with the longitudinal axis $\mathbf{11}_A$ of the shield 11.

As illustrated in FIGS. 16-17, the high voltage component as described above can be a shielded x-ray tube 160. The high voltage device 13 described above can be an x-ray tube 163, the high voltage insulation 22 described above can be x-ray tube insulation 162, and the shield 11 described above can be an x-ray tube shield 161. The x-ray tube 163 can include a cathode 165 and an anode 164 electrically insulated from one another. The cathode 165 can be configured to emit electrons in an electron beam towards the anode 164, and the anode 164 can be configured to emit x-rays out of the x-ray tube in response to impinging electrons from the cathode 165. A longitudinal axis $\mathbf{163}_A$ of the x-ray tube 163 can extend along a center of the electron beam and between the cathode 165 and the anode 164. The longitudinal axis $\mathbf{163}_A$ of the x-ray tube 163 can be parallel to or aligned or coaxial with the longitudinal axis $\mathbf{11}_A$ of the shield 11.

As illustrated in FIGS. 18-20, a voltage multiplier 143 can be electrically coupled to an x-ray tube 163 by an electrical connection 182. The voltage multiplier 143 can be part of a shielded power supply 140 as described above, the x-ray tube 163 can be part of a shielded x-ray tube 160 as described above, or both. The x-ray tube shield 161 can be separate from and spaced apart from the power supply shield 141. The shielded power supply 140 can be spaced apart from the shielded x-ray tube 160.

An enclosure 181 can at least partially surround the electrical connection 182, the x-ray tube 163 (or shielded x-ray tube 160), and the voltage multiplier 143 (or shielded power supply 140). An outer insulation 202 can electrically insulate the enclosure 181 from these components located therein. The outer insulation 202 can be solid and electrically insulative material. The outer insulation 202 can be sandwiched between the enclosure 181 and the electrical connection 182, the shielded x-ray tube 160, and the power supply 140. The enclosure 181 can be electrically conductive.

Following are characteristics of materials of the components of the various embodiments of the inventions described herein. A material composition of the shield 11, the high voltage insulation 22, and the outer insulation 202 can be selected for optimal insulation of the high voltage device(s) 13 from the enclosure 181 or other grounded components. For example, a material composition of the shield 11 can be different than a material composition of the high voltage insulation 22, different than a material composition of the outer insulation 202, or both.

Further, for optimal insulation of the high voltage device(s) 13, a relative permittivity of the shield 11 can be greater than a relative permittivity of the outer insulation 202, greater than relative permittivity of the high voltage insulation 22, or both. For example, relative permittivity of the shield 11 divided by relative permittivity of the high voltage insulation 22 can be ≥1.5, ≥2, ≥2.5, ≥3, or ≥5. The relative permittivity of the outer insulation 202 can be greater than a relative permittivity of the high voltage insulation 22. For example, relative permittivity of the outer insulation 202 divided by relative permittivity of the high voltage insulation 22 can be ≥1.3, ≥1.5, ≥2, ≥2.5, or ≥3.

Also, for optimal insulation of the high voltage device(s) 13, material composition of the shield 11 can be inorganic, material composition of the high voltage insulation 22 can be organic, material composition of the outer insulation 202 can be organic, or combinations thereof. Material composition of the high voltage insulation 22, material composition of the outer insulation 202, or both, can include a polymer. The shield 11 can be harder than the high voltage insulation 22, harder than the outer insulation 202, or both. For example, the high voltage insulation 22, the outer insulation 202, or both, can have a Shore hardness of ≥10A, ≥20A, ≥30A, ≥40A, or ≥45A and ≤65A, ≤70A, ≤80A, or ≤90A. For example, the shield 11 can have a Vickers hardness of ≥2.5 GPa, ≥5 GPa, ≥10 GPa, or ≥13 GPa and ≤17.5 GPa, ≤20 GPa, or ≤22 GPa.

A method of manufacturing a high voltage component can comprise some or all of the following steps, which can be performed in the following order. There may be additional steps not described below. These additional steps may be before, between, or after those described.

Figure 1:
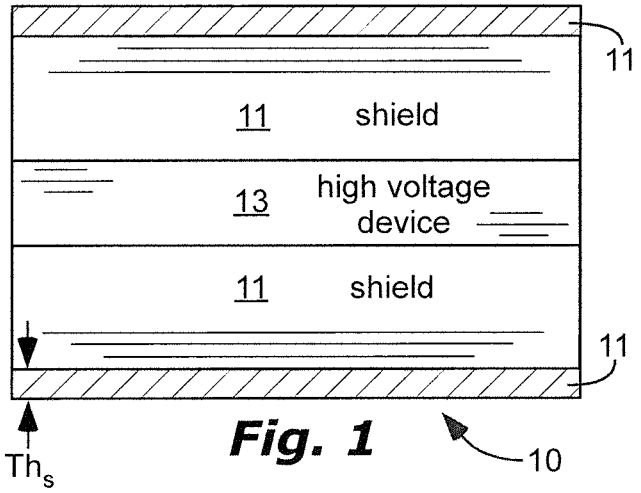

As illustrated in FIG. 1, one step can include inserting a high voltage device 13 inside of a shield 11, the shield 11 wrapping at least a portion of the high voltage device 13 with a gap between the shield 11 and the high voltage device 13. The gap can be an annular gap. The shield 11 and the high voltage device 13 can have properties as described above.

As illustrated in FIG. 2*a*, another step can include inserting a high voltage potting compound 21 into the gap. The high voltage potting compound 21 can be a liquid. The high voltage potting compound 21 can be adjacent to both the shield 11 and the high voltage device 13.

The shield 11 can have various shapes for holding the liquid, such as for example a cube or a cylinder. Alternatively, the shield 11 can have a partially open shape such as shown in FIG. 4. Any openings other than the top can be sealed with Kapton tape or other similar material until the high voltage potting compound 21 has cured into a solid.

As illustrated in FIG. 2*b*, another step can include curing the high voltage potting compound 21 into a solid, electrically insulative material, defining high voltage insulation 22. Various curing methods can be used, including curing with heat, x-rays, or ultraviolet rays.

Another step can include testing performance of the high voltage device 13. For example, if the high voltage device 13 is a voltage multiplier 143, its voltage output capabilities can be tested now that it is embedded in the power supply insulation 142. As another example, if the high voltage device 13 is an x-ray tube 163, a bias voltage of several kilovolts can be applied between the cathode 165 and the anode 164, its electron emitter can be activated, and its x-ray output can be analyzed. It can be advantageous to test at this stage, before connecting the voltage multiplier 143 to the x-ray tube 163, and adding outer insulation 202 around both devices, because after this latter step, both devices may need to be scrapped if one is defective. Thus, it is helpful to know earlier in the process whether one of the high voltage devices 13 is functional.

Some or all of the above steps can be performed on a voltage multiplier 143, on an x-ray tube 163, or each of these two devices separately. As illustrated in FIG. 18, an electrical connection 182 can be made between the voltage multiplier 143 and the x-ray tube 163. The shielded power supply 140, the shielded x-ray tube 160, or both can be placed at least partially inside of an enclosure 181. The electrical connection 182 made between the voltage multiplier 143 and the x-ray tube 163. The enclosure 181 can be electrically conductive.

As illustrated in FIG. 19, another step can include inserting an outer potting compound 191 into the enclosure 181. The outer potting compound 191 can be a liquid and can at least partially or can completely surround the electrical connection 182, the shielded power supply 140, the shielded x-ray tube 160, or combinations thereof.

As illustrated in FIG. 20, another step can include curing the outer potting compound 191 into an outer insulation 202. Various curing methods can be used, including curing with heat, x-rays, or ultraviolet rays. The outer insulation 202 can be solid and electrically insulative and can have a material composition different from a material composition of the shield(s) 11. The outer insulation 202 can have properties of the high voltage insulation 22 as described above.

The above method can allow a relatively easier method for manufacture of x-ray sources with reduced scrap parts. The above method can also provide relatively small, light x-ray sources with high voltage standoff capabilities relative to size.

What is claimed is:

1. A shielded x-ray source comprising:
- a shielded x-ray tube including:
  - an x-ray tube configured to emit x-rays;
  - an x-ray tube shield wrapping at least partially around the x-ray tube;
  - the x-ray tube shield spaced apart from the x-ray tube by an arcuate gap; and
  - x-ray tube insulation separating the x-ray tube shield from the x-ray tube, the x-ray tube insulation comprising a solid, electrically-insulative material with a different material composition than a material composition of the x-ray tube shield;
- a shielded power supply including:
  - a voltage multiplier;
  - a power supply shield wrapping at least partially around the voltage multiplier, the power supply shield being spaced apart from the voltage multiplier by a gap;
  - power supply insulation separating the power supply shield from the voltage multiplier; and
  - the power supply insulation comprising a solid, electrically-insulative material having a different material composition than a material composition of the power supply shield;
- the x-ray tube electrically coupled to the voltage multiplier; and
- the x-ray tube shield separate from and spaced apart from the power supply shield.

2. The shielded x-ray source of claim 1, further comprising:
- an enclosure at least partially surrounding the shielded power supply and the shielded x-ray tube;
- an outer insulation sandwiched between and electrically insulating the shielded x-ray tube and the shielded power supply from the enclosure;
- the material composition of the power supply shield is different than a material composition of the outer insulation; and
- the material composition of the x-ray tube shield is different than the material composition of the outer insulation.

3. The shielded x-ray source of claim 2, wherein the x-ray tube shield is electrically insulative, the power supply shield is electrically insulative, the material composition of the x-ray tube shield is inorganic, the material composition of the x-ray tube insulation is organic, the material composition of the power supply shield is inorganic, the material composition of the power supply insulation is organic, and the material composition of the outer insulation is organic.

4. The shielded x-ray source of claim 3, wherein:

a relative permittivity of the x-ray tube shield is greater than a relative permittivity of the outer insulation;

the relative permittivity of the outer insulation is greater than a relative permittivity of the x-ray tube insulation;

a relative permittivity of the power supply shield is greater than the relative permittivity of the outer insulation; and the relative permittivity of the outer insulation is greater than a relative permittivity of the power supply insulation.

5. The shielded x-ray source of claim 1, wherein the material composition of the x-ray tube insulation and the material composition of the power supply insulation each include a polymer.

6. The shielded x-ray source of claim 1, wherein:

the x-ray tube insulation and the power supply insulation each have a Shore hardness of ≥20A and ≥90A and electrical resistivity of at least $10^{14}$ ohm*cm; and the x-ray tube shield and the power supply shield each have a Vickers hardness of ≥5 GPa and ≤22 GPa.

7. The shielded x-ray source of claim 1, wherein:

a hardness of the x-ray tube shield is greater than a hardness of the x-ray tube insulation; and a hardness of the power supply shield is greater than a hardness of the power supply insulation.

8. A shielded x-ray tube comprising:

an x-ray tube configured to emit x-rays;

an x-ray tube shield wrapping at least partially around the x-ray tube, the x-ray tube shield being electrically insulative;

the x-ray tube shield spaced apart from the x-ray tube by an arcuate gap; and x-ray tube insulation separating the x-ray tube shield from the x-ray tube, the x-ray tube insulation comprising a solid, electrically-insulative material with a different material composition than a material composition of the x-ray tube shield.

9. The shielded x-ray tube of claim 8, further comprising:

a power supply electrically coupled to the x-ray tube;

an enclosure at least partially surrounding the power supply and the x-ray tube;

an outer insulation sandwiched between and electrically insulating at least part of the x-ray tube and at least part of the power supply from the enclosure; and a material composition of the x-ray tube shield is different than a material composition of the outer insulation.

10. The shielded x-ray tube of claim 8, wherein relative permittivity of the x-ray tube shield is greater than relative permittivity of the x-ray tube insulation.

11. The shielded x-ray tube of claim 8, wherein relative permittivity of the x-ray tube shield divided by relative permittivity of the x-ray tube insulation is ≥2.

12. The shielded x-ray tube of claim 8, wherein a minimum thickness of the x-ray tube shield is ≥1 mm and maximum thickness of the x-ray tube shield is ≤5 mm.

13. The shielded x-ray tube of claim 8, wherein an external surface of the x-ray tube shield is corrugated, an internal surface of the x-ray tube shield is corrugated, or both.

14. The shielded x-ray tube of claim 8, further comprising:

an external surface of the x-ray tube shield is corrugated, defining a corrugated external surface;

a ridge and a furrow of the corrugated external surface extend in a continuous spiral from one open end of the x-ray tube shield to an opposite open end of the x-ray tube shield;

a coating on the ridge, extending in a continuous line of material on the continuous spiral;

electrical resistance from one end to an opposite end of the line of material is between 100 megaohms and 100,000 megaohms; and the line of material is a voltage sensing resistor electrically-coupled across and configured for measurement of voltage across the x-ray tube, a voltage multiplier or both.

15. The shielded x-ray tube of claim 8, wherein:

the x-ray tube shield has two open ends located opposite of each other;

the shielded x-ray tube further comprises a coating on a surface of the x-ray tube shield, the coating being a continuous layer;

electrical resistance of the coating is between 100 megaohms and 100,000 megaohms, where the electrical resistance of the coating is measured between the coating closest to one open end of the x-ray tube shield and the coating closest to the opposite open end of the x-ray tube shield;

the coating is a line of material wrapping multiple times around the x-ray tube shield, arranged in a serpentine pattern, or both; and the coating is a voltage sensing resistor electrically-coupled across and configured for measurement of voltage across the x-ray tube, an x-ray tube, or both.

16. The shielded x-ray tube of claim 15, wherein a length of the line of material is at least 20 times a shortest distance between the two open ends of the x-ray tube shield.

17. The shielded x-ray tube of claim 8, wherein:

the x-ray tube shield has a conical frustum shape with two open ends including a wider end and a smaller end, the wider end being ≥1.2 times larger than the smaller end;

the wider end is closer to a location on the x-ray tube with a highest absolute value of voltage; and the smaller end is closer to a location on the x-ray tube with a lowest absolute value of voltage.

18. A shielded power supply for an x-ray source, the shielded power supply comprising:

a voltage multiplier;

a power supply shield wrapping at least partially around the voltage multiplier, the power supply shield being electrically insulative and being spaced apart from the voltage multiplier by a gap;

power supply insulation separating the power supply shield from the voltage multiplier;

the power supply insulation comprising a solid, electrically-insulative material having a different material composition than a material composition of the power supply shield.

19. An x-ray source comprising the shielded power supply of claim 18, the x-ray source further comprising:

an x-ray tube;

the shielded power supply electrically coupled to the x-ray tube;

an enclosure at least partially surrounding the shielded power supply and the x-ray tube;

an outer insulation sandwiched between and electrically insulating at least part of the x-ray tube and at least part of the shielded power supply from the enclosure;

a material composition of the power supply shield is different than a material composition of the outer insulation.

20. The x-ray source of claim 19, further comprising an x-ray tube shield wrapping at least partially around the x-ray tube, wherein:

the x-ray tube shield is electrically insulative and spaced apart from the x-ray tube by an arcuate gap; and x-ray tube insulation separates the x-ray tube shield from the x-ray tube, the x-ray tube insulation comprising a solid, electrically-insulative material with a different material composition than a material composition of the x-ray tube shield.

* * * * *